United States Patent [19]

Stumpmeier

[11] 4,080,983

[45] Mar. 28, 1978

[54] VALVE BASE FOR CONNECTING HYDRAULIC VALVES IN HYDRAULIC CIRCUITS

[76] Inventor: Fritz Stumpmeier, Mozartstrasse 7, 7910 Neu-Ulm, Germany

[21] Appl. No.: 685,357

[22] Filed: May 11, 1976

[30] Foreign Application Priority Data

May 15, 1975 Germany ..... 2521680
Feb. 10, 1976 Germany ..... 2605155

[51] Int. Cl.[2] ..... F17D 1/00

[52] U.S. Cl. ..... 137/271; 137/561 A; 137/861

[58] Field of Search ..... 137/271, 561 A, 608, 137/269, 625.69

[56] References Cited

U.S. PATENT DOCUMENTS

| | | | |
|---|---|---|---|
| 1,733,421 | 10/1929 | Mauran | 137/271 |
| 2,920,650 | 1/1960 | Moog, Jr. | 137/625.69 |
| 3,163,175 | 12/1964 | Pearson | 137/625.69 |
| 3,175,578 | 3/1965 | Patterson et al. | 137/561 A |
| 3,195,574 | 7/1965 | Carls | 137/608 |
| 3,219,053 | 11/1965 | Hupp | 137/269 |
| 3,457,943 | 7/1969 | Kawabata | 137/608 |
| 3,552,442 | 1/1971 | Knowles | 137/625.69 |
| 3,707,989 | 1/1973 | Jullien-Davin | 137/271 |
| 3,754,565 | 8/1973 | Gennetten | 137/271 |
| 3,766,943 | 10/1973 | Murata | 137/608 |
| 3,826,282 | 7/1974 | Noe | 137/625.69 |
| 3,881,513 | 5/1975 | Chang | 137/271 |
| 3,934,605 | 1/1976 | Legris | 137/271 |
| 3,960,166 | 6/1976 | Linser | 137/271 |

*Primary Examiner*—William R. Cline
*Assistant Examiner*—H. Jay Spiegel
*Attorney, Agent, or Firm*—Haseltine, Lake & Waters

[57] ABSTRACT

A valve base for establishing connections to valves in hydraulic circuits comprises a base having in it a number of coplanar longitudinal channels, groups of holes each in a standardized pattern to fit a standardized pattern of connections of a hydraulic valve, and a transverse bore associated with each group of holes and intersecting all the longitudinal channels. Each transverse bore contains a column of distributor modules held by terminal members at the ends of the bore. The distributor modules are of different types of hollow cylinder and are separated by discs which may be solid or annular so as to block or permit flow along the bore. A module may have one or two lateral openings, or a circumferential groove in its external surface, to provide a choice of connections.

A valve of cartridge type may be incorporated as a module, either fitting directly in the bore or with an adaptor, or may be incorporated in a terminal member.

A base for any number of valves may be built up from two or more bases, each having a smaller number of groups of holes and transverse bores, by joining them end to end.

18 Claims, 20 Drawing Figures

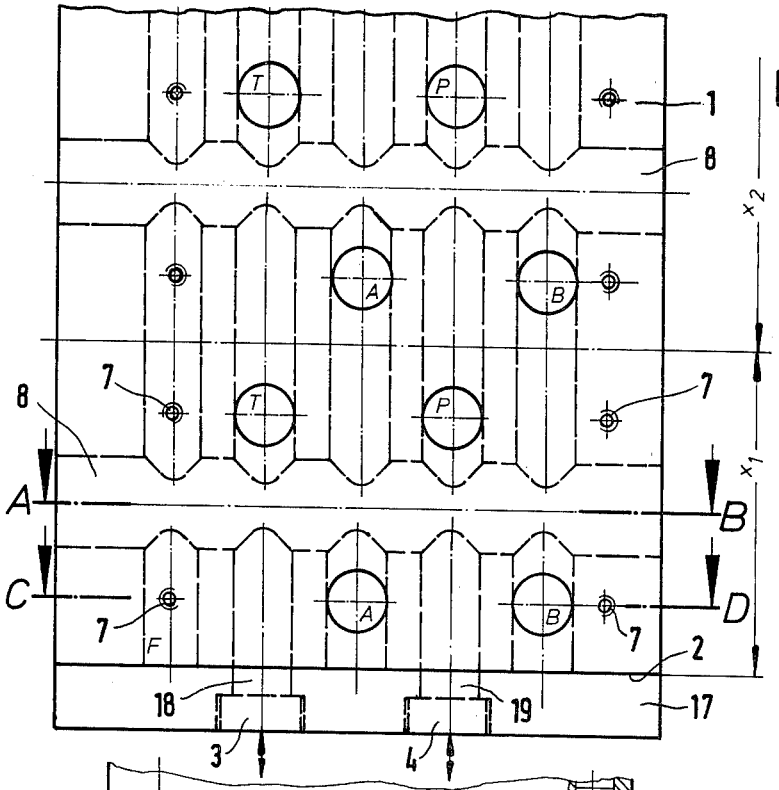
FIG.1
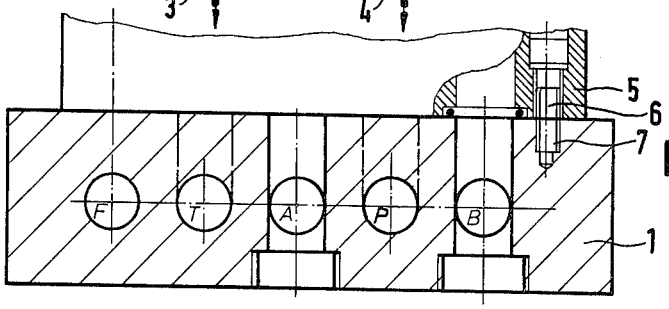
FIG.2
FIG.3
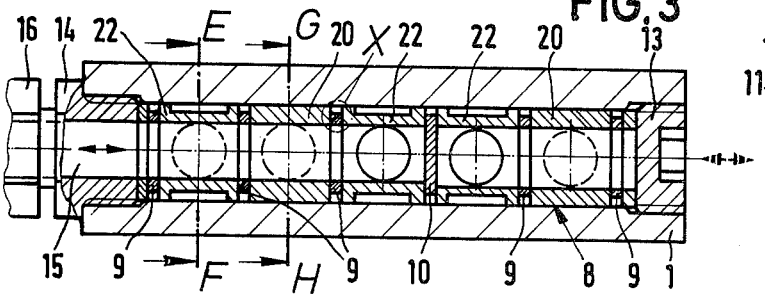
FIG.4
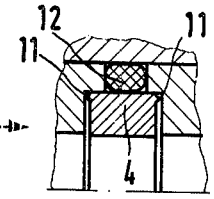
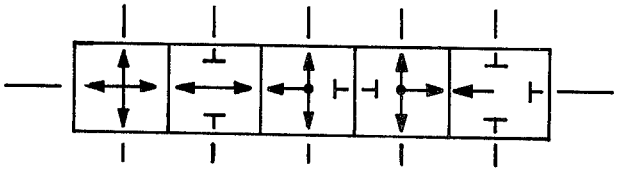
FIG.5

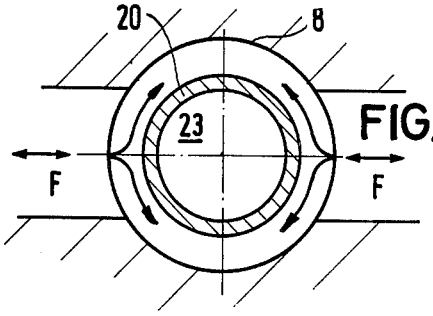
FIG.6
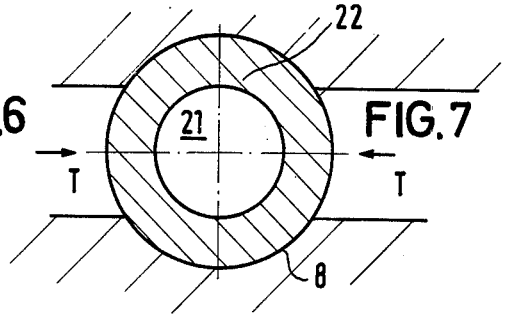
FIG.7
FIG.8
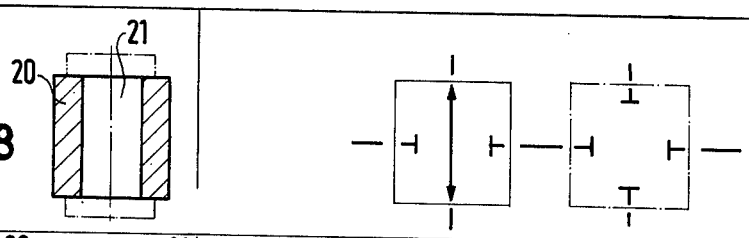
FIG.9
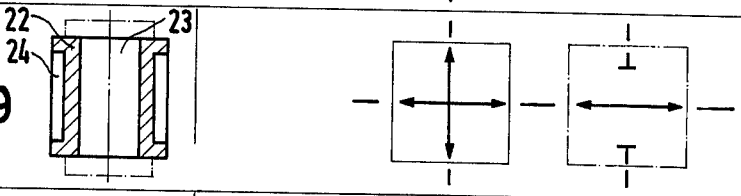
FIG.10
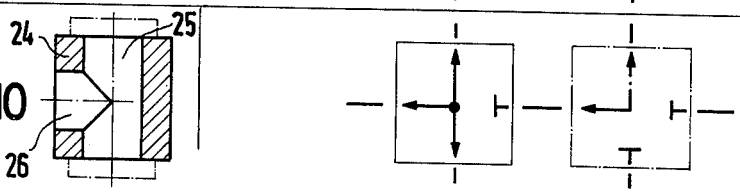
FIG.11
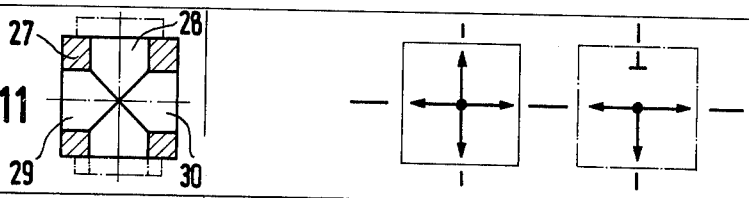
FIG.12
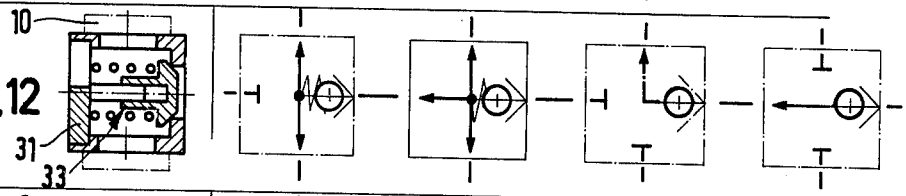
FIG.13
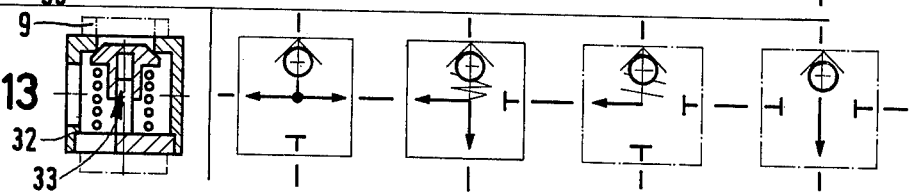

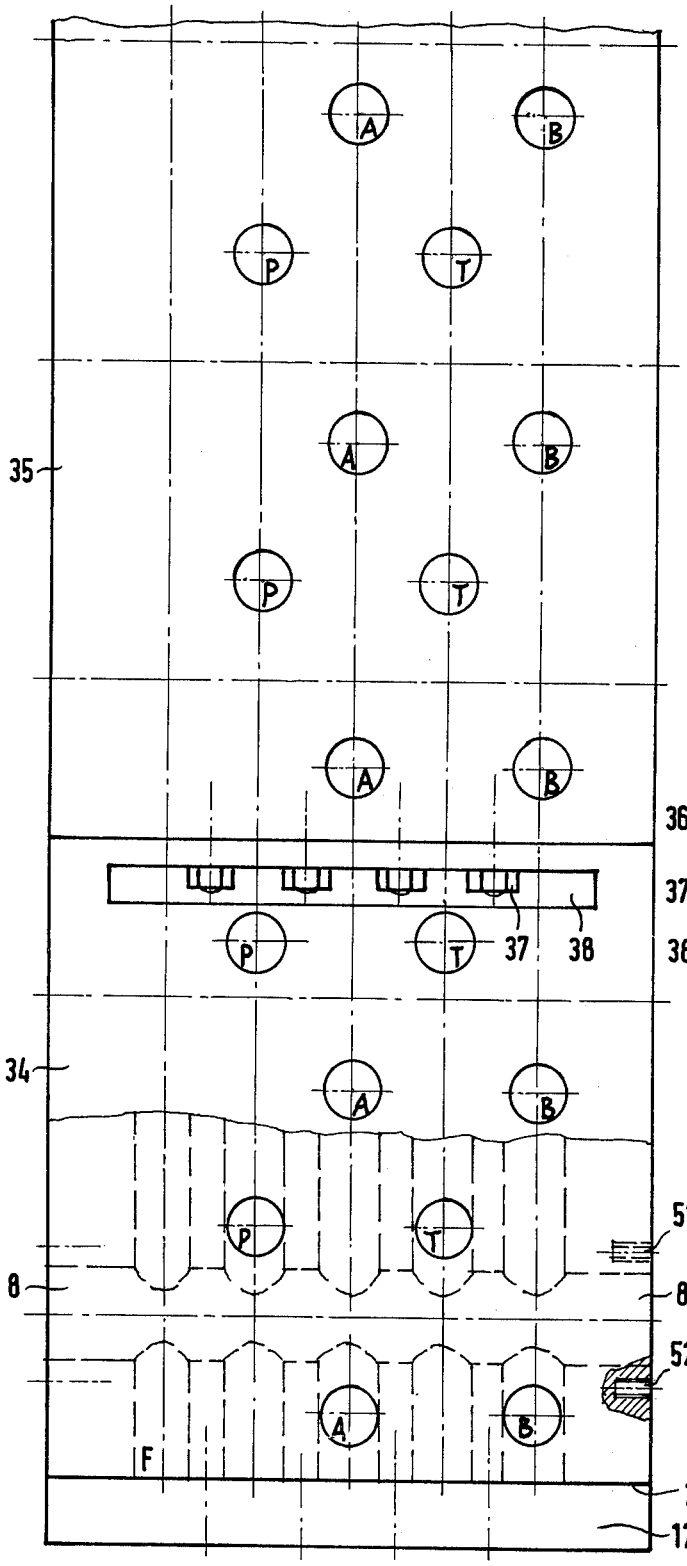
FIG. 17
FIG. 18
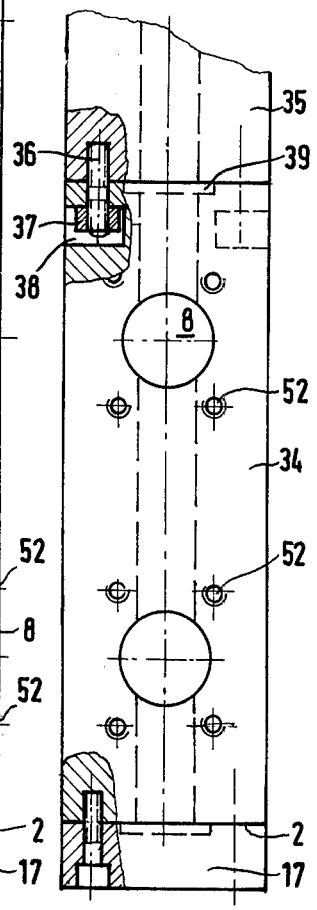

VALVE BASE FOR CONNECTING HYDRAULIC VALVES IN HYDRAULIC CIRCUITS

This invention relates to bases for connecting hydraulic valves in hydraulic circuits, comprising a body having longitudinal channels extending from end to end through it for the supply and return of a hydraulic fluid and for establishing hydraulic connections between the valves and the users, and optionally any connections required for hydraulic control, and having groups of holes each in a standardised pattern to fit a standardised pattern of connections of a hydraulic valve.

Known systems for connecting hydraulic valves while minimising the use of pipes are referred to as interlink systems. They consist of a separate unit for mounting each hydraulic valve. These bases are screwed together with the interposition of different kinds of junction plates. By an appropriate choice of the junction plates a passage from base to base can be established or blocked. Furthermore, a diverter plate can be used for inter-connecting different longitudinal channels.

These interlink systems permit individual hydraulic valves to be subsequently replaced or entire connections to be undone, but they have the inherent drawback that once the bases have been assembled and the system is complete there is no possible way of subsequently modifyng the circuitry other than by completely dismantling all the bases as well as the associated installed pipework. Furthermore, such interlink systems have in the past been constructed only for relatively minor combinations. This is due to the fact that in combinations of major size the screwed joints between the unit bases are subject to considerable stresses which impose an upper limit on the size of the association.

Furthermore, for making the longitudinal channels in the bases fluid and pressure tight a large number of joints have to be sealed and if the seals are not all perfect leakage results. Also, the inclusion of diverter plates for change-overs between channels takes up valuable space.

Besides interlink systems in which separate valve bases are screwed together there are also systems comprising multiple bases for mounting several hydraulic valves. However, these multiple bases can be used only for components which have holes drilled in identical patterns or groupings, the valves being connected in common to the supply and return channels. The creation of inter-connections between the channels, and a change-over of oil streams from channel to channel is impossible.

It is an object of the present invention to provide a more flexible and versatile system of interlinkage, notwithstanding the employment of fewer parts, and at the same time to enable the nature of the circuitry to be modified without the need for dismantling, even after the system has been completely installed.

According to the present invention a valve base for connecting hydraulic valves in hydraulic circuits, comprises a body affording a number of longitudinal channels extending end to end through it with their axes coplanar, for the supply and return of a hydraulic fluid and for other hydraulic connections from the valves, groups of holes each in a standardised pattern to fit a standardised pattern of connections of a hydraulic valve, a transverse bore associated with each group of holes and intersecting all the longitudinal channels, and in each transverse bore, a column of distributor modules which are held in the bore by terminal members at the ends of the transverse bore, one distributor module being located at each intersection of the transverse bore with each longitudinal channel.

In this simple system it is possible, even in a single base, to change the circuit design at will simply by fitting suitably constructed distributor modules into the transverse bores in the base. Generally speaking, the pattern of holes in each group will be designed for mounting hydraulic valves of the same size, for instance valves complying with the standard grouping of holes for way-valves specified in German Standard Specification DIN 24 340. By far the greater number of hydraulic valves needed for such hydraulic circuits are way valves, that is to say valves which allow or cut off the flow through a particular path or each of a number of paths rather than throttling the flow or controlling the pressure. Intermediate plates may be used for other patterns of holes. The essence of the matter is that the design of the circuit, i.e. the connections between the channels in the base, can be selected at will as required by a suitable arrangement of the distributor modules in the transverse bore associated with the grouping of holes to which the hydraulic valve mounted on the base is connected. Preferably the transverse bores have a diameter exceeding that of the longitudinal channels.

The distributor modules may be cylindrical bodies having an external diameter corresponding to the internal diameter of the transverse bores and each provided with an axial bore extending through it. Conveniently they are spaced apart by spacing discs which may be solid to form a partition blocking the transverse bore, or annular to allow flow through it. To establish different circuit connections each distributor module may take any one of various forms. Thus it may have a lateral opening, or two diametrically opposite lateral openings communicating with its axial bore, or it may have a circumferential groove in its external surface.

Preferably the body of each valve base contains 4, 5 or more longitudinal channels. If there are five, as in an embodiment that will be later described, these channels are used as follows:- one channel P for the pump, one channel T for the oil tank, two channels A and B for the user or actuator, and one channel F being free. These channels can be optionally interconnected or blocked by distributor modules or rendered suitable for only one-way flow by the insertion of check valves in place of distributor modules into the transverse bore associated with each grouping of holes, i.e. with each valve on the base. The channels and bores may also cross over without intercommunication. The distributor modules, of which there are as many in each transverse bore as there are channels in the base, and their associated spacing rings or blocking discs can be selectably arranged to provide an axial passage or to block it. The spacing rings or spacing discs also form the necessary metal seals between the distributor modules in the axial direction of the transverse bore.

In the present state of the art a distinction is made between two essentially different types of valve. On the one hand, the piston valve, usually in the form of a way valve, may have an internationally standardised pattern of holes for external connection and, on the other hand, there is the recently increasingly frequent type of cartridge valve, which fits into a standard socket or housing, for way and pressure control as well as for one-way and flow control. A combination of several such cartridge valves and their different functions permits a multiplicity of hydraulic circuits to be established. However, a hydraulic circuit system formed exclusively of cartridge valves is economical only for very large cross sections (pipe diameters) or, as a complete control assembly, only for machines made in large numbers. In medium gauge systems and in relatively small numbers it is cheaper, according to the necessary function, optionally to use way valves of the standardised type (using pistons) as well as cartridge valves for way and pressure control and as flow control and check valves.

Thus in one form of the present invention at least one distributor module contains a valve controlling flow through its axial bore or through a lateral opening. Such a way valve may be in the form of a push-in cartridge having an overall diameter corresponding to the diameter of the transverse bores, and having an opening in the axial direction of the transverse bore, and an opening communicating with one of the longitudinal channels.

This arrangement is particularly useful because the existing transverse bore in the proposed valve base can be used, without the expenditure of additional means, as a housing already containing the inlet and outlet channels for receiving cartridge valves.

If the external diameter of the cartridge type way valve should be less than that of the transverse bore, then an adaptor sleeve may be interposed between the way valve and the wall of the transverse bore. Such way valves may also be fitted at one or both ends of the column of distributor modules in a transverse bore. In such a case the provision of a connection for the purposes of control, which is necessary for a way valve, can be particularly easily provided because end plates for the joining up of control pipes for the way valve or valves will be on the outside of the base where these plates form the terminal members closing the ends of the transverse bores. If such a way valve is required in the interior of a column of distributor modules other means must naturally be devised to enable the valve to be controlled. Generally in such a case the provision of a special bore in the body will be needed.

In a further arrangement which provides facilities for other combinations by means of way valves in the interlink system, the terminal members for sealing the ends of the transverse bore may be modified to form the housing of a cartridge valve of any type, having an inlet or outlet in the axial direction of the transverse bore and a corresponding exit or entry outside the base for connecting the valve to an external pipe. This arrangement offers particular advantages because the terminal member which is modified to form the body of the assembly valve provides a number of further possibilities for combination in the design of hydraulic circuitry. More particularly, since in addition to the hydraulic valves mounted on the base additional valves can be fitted on the sides, a very high density of association and interlinkage can be achieved.

The proposed valve base is not subject to limitation regarding its strip length and the number of bore hole groupings it can provide and the number of hydraulic valves that can thus be associated. In principle it would be possible to produce a relatively long strip base for a multiplicity of associated hydraulic valves either by casting or by machining. However, if valve bases of different lengths are made to suit customers' specific requirements, a very large number of different lengths of valve base must be kept in stock.

Thus it may be preferable to produce only bodies having a prescribed relatively small number of standard groupings of holes and transverse bores and to assemble several bodies to the appropriate strip length for a particular association of valves by connecting together the end faces with the longitudinal channels in alignment. For example, if only two different lengths of base are made available, one having two and the other three adjacent standardised hole groupings, then this raster permits associative combinations of any length comprising from two hole groupings to any number of hole groupings to be constructed. Alternatively, two bases may be made available, one having one and the other three adjacent standardised hole groupings. In such a case any associative strip lengths of combinations ranging from one to any desired number of standardised hole groupings and transverse bores can be built up.

Further features and details of the invention will be apparent from the following description of certain specific embodiments that will be given by way of example with reference to the accompanying drawings in which FIG. 1 is a fragmentary view of a valve base according to the invention seen from above, the channels and transverse bores being indicated in dot-dash outlines;

FIG. 2 is a cross section taken on the line C–D in FIG. 1;

FIG. 3 is a cross section taken on the line A–B in FIG. 1, showing distributor modules fitted in a transverse bore;

FIG. 4 is a section of part X in FIG. 3 on a larger scale;

FIG. 5 is a symbolic representation of the connections established by the distributor modules in FIG. 3;

FIG. 6 is a larger scale section taken on the line E–F in FIG. 3;

FIG. 7 is a larger scale section taken on the line G–H in FIG. 3;

FIGS. 8 to 13 are sections of individual distributor modules and, on the right, are symbolic representations of the connections that can be established according to whether the modules are separated from the neighbouring modules by a spacing ring or by a solid disc;

FIG. 17 is a diagrammatic part sectional view from above of a valve base built up of a 2- and 3- raster unit.

FIG. 18 is a part sectional side view of the valve base according to FIG. 17;

Figure 19:
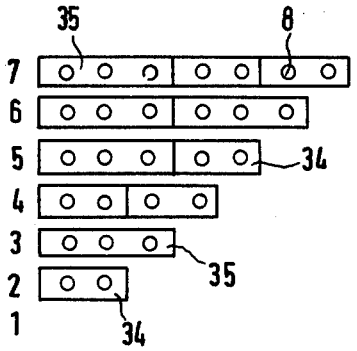
Figure 20:
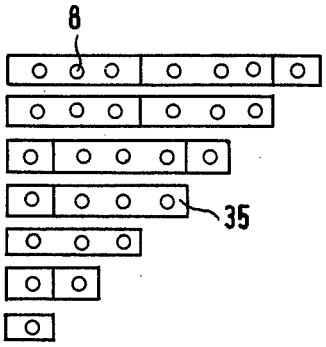

FIG. 19 is a diagram indicating the possibilities of combining 2- and 3- raster units to form strips, and FIG. 20 is a diagram showing the possibilities of combining 1- and 3- raster units to form strips.

FIGS. 1 and 2 show a valve base comprising a body 1, having five longitudinal channels extending from end of end of it, one being an entry channel (P) for connection to a pump, one a return channel (T) for connection to a tank, two being channels A and B for connection to users, and one a free channel F. The channels T and P communicate with pipes (not shown) leading to the tank and pump, through a cover 17 which is secured to one end face 2 of the valve body 1 and provided with holes 18, 19 aligning with the channels T and P and forming threaded pipe sockets 3 and 4. At the same time the cover 17 seals the ends of the other channels A, B and F. The upper surface of the body 1 contains a repeat pattern of groups of holes which communicate with the channels T, P, A, B and on which hydraulic valves accordingto German Standard Specification DIN 24340 can be mounted. FIG. 1 shows two such groups of holes occupying areas indicated by $x_1$ and $x_2$. The open ends of the holes in each group are identified by the same reference letters as the channels with which they communicate. In FIG. 2 a hydraulic valve 5 is indicated mounted on a hole in group $x_1$. These hydraulic valves 5 are secured to the valve base 1 by screws 6 and, as will be understood from FIG. 1, tapped holes 7 are provided in the body 1 for the reception of the screws 6.

The body 1 also contains transverse bores 8 which, as shown in FIG. 3, intersect the coplanar passages T, P, A, B, F. Distributor modules which are inserted in these transverse bores are not indicated in FIG. 1. They are shown in FIG. 3 and will be later described.

The number of transverse bores 8 depends upon the number of repeat patterns of groups of holes contained in the areas $x_1$, $x_2$, etc. However, as illustrated in FIG. 1, it has proved convenient to locate the transverse bores 8 symmetrically in the centre of each group of holes. This has the advantage that the required body 1 can be cut from a longer bar-shaped parent strip without cutting through one of the transverse bores 8. The association of an uncut transverse bore 8 with each group of holes will thus be preserved.

As shown in FIGS. 3 to 13 each transverse bore 8, which preferably has a diameter exceeding that of the channels T, P, A, B, F, contains a number of closely adjacent distributor modules of different types constructed as exemplified in FIGS. 8 to 13. Adjacent distributor modules are separated by spacing rings 9 or solid discs 10. It will be seen in FIG. 4 that sharp-edged circumferential ribs 11, one formed on the periphery of each face of the spacing rings 9 (and analogously on the spacing discs 10) form seals between neighbouring distributor modules in the axial direction of the bore 8. Radial seals are formed by O-rings 12 encircling each spacing disc or ring whose diameter is chosen to provide space for them. The ends of the transverse bores 8 are closed by terminal members in the form of plugs 13, 14, which tightly clamp the column of distributor modules together inside the transverse bore 8 and thus ensure the maintenance of the seals. In the embodiment exemplified in FIG. 3, the screw plug 14 contains a bore 15 for a pipe connection 16.

Suitable choice of the distributor modules shown in FIGS. 8 to 13 enables the interconnections required for a desired hydraulic circuit between the channels T, P, A, B, F to be achieved. The interconnections established by the distributor modules in FIG. 3 and their interposed spacing rings 9 and discs 10 are shown in symbolic form in FIG. 5. The number of distributor modules in one transverse bore 8 must naturally always agree with the number of channels in the valve base.

All the distributor modules in FIGS. 8 to 13 have a cylindrical body which has an external diameter corresponding to the internal diameter of the transverse bores 8. The distributor module 20 in FIG. 8 contains an axial end-to-end bore 21. This distributor module 20 permits the two interconnections symbolically indicated on the right to be created, according to whether the bore 21 through the module when the latter is in position abuts solid spacing discs 10 which close the bore, or spacing rings 9 which give access to the bore. These spacing elements abutting the open ends of the bore through the module are indicated in dot-dash outline in FIGS. 8 to 13.

The distributor module 22 in FIG. 9 contains a similar axial bore and, in addition, it is provided with a peripheral groove 24 recessed into its outer circumferential surface. In conjunction with spacing discs 10 or spacing rings 9 the interconnections shown on the right can be established. These effects of the distributor modules 20 and 22 in FIGS. 8 and 9 will be readily understood by reference to the cross sections in FIGS. 7 and 6.

The distributor module 24 in FIG. 10 has an axial bore 25 with a lateral opening 26 in one side. The interconnections symbolised on the right can be established with this module.

The distributor module 27 in FIG. 11 has a diametral opening 29, 30 on each side of its axial bore 28 so that the interconnections shown symbolically on the right of FIG. 11 can be provided.

The distributor modules 31 in FIG. 12 and 32 in FIG. 13 each contain a check valve 33 of conventional design. According to the orientation of the check valve inside the distributor module 31 and 32 the symbolised circuit elements shown on the right in FIGS. 12 and 13 can be created.

It is a major advantage of the invention that when the valve base 1 has been completed, hydraulic valves 2 having been mounted thereon and distributor modules 8 inserted in the transverse bores 8, it is still possible subsequently, by the removal of a screw plug 13 or 14 and by the replacement and/or exchange of distributor modules in the transverse bore 8, to modify the hydraulic circuitry without much trouble. The use of a screw plug 14 containing an axial bore 15, as seen in FIG. 3, for a pipe connection 16, enables an additional stream of oil to be introduced into or withdrawn from the system.

Figure 14:
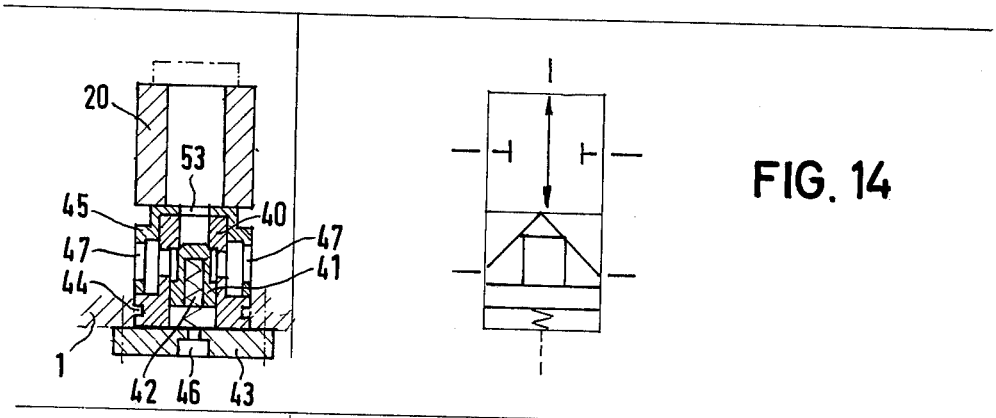
FIG. 14 is a section of a distributor module associated with a second distributor module in the form of a 2/2-way cartridge valve, the corresponding circuit element being symbolically shown on the right.

FIG. 14 illustrates the association of a distributor module 20 of the type having only an axial bore with a cartridge type way valve which is insertable into a transverse bore 8 in place of a distributor module. This valve comprises a bush 40, a piston 41, a spring 42 urging the piston into a seat in the bush 40, a control plate 43 and an O-ring 44 for sealing the bush 40 inside the transverse bore 8. The control plate 43 of the valve is bolted to the valve base 1 and replaces for instance one of the plugs 13 and 14 shown in FIG. 3. The control plate 43 contains the connecting bore 46 for admitting a pressure fluid controlling the position of the valve. This cartridge type way valve (a seated 2/2-way valve) has a diameter less than that of the transverse bore 8 and is accordingly inserted in place of a distributor module after a special spacing and sealing sleeve 45 (adapter sleeve) has been introduced. The sleeve 45 may be optionally provided with only one lateral bore and may thus close the connection to one of the longitudinal channels in the base 1 or, as illustrated, it may be provided with two lateral openings 47 on opposite sides. The provision of such a way valve according to FIG. 14 permits connections between channels in the valve base 1 to be optionally controlled and switched.

Figure 15:
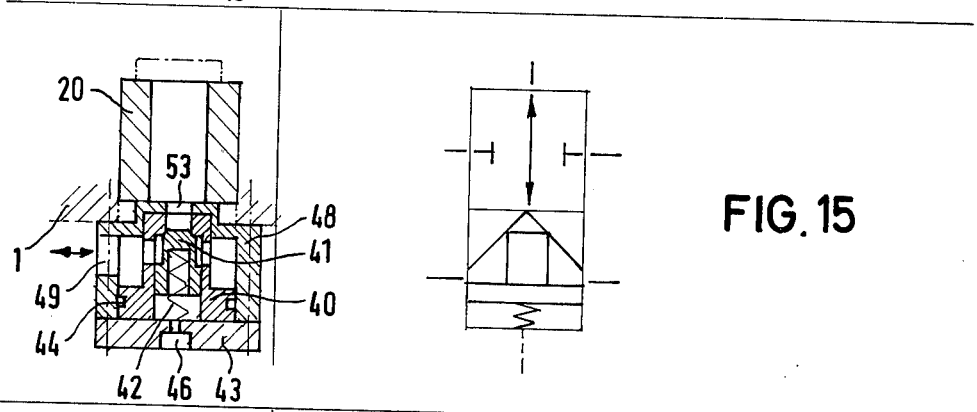
FIG. 15 is a section of a distributor module and a terminal member modified to form the body of a cartridge type way valve, the corresponding circuit element again being shown on the right.

In the embodiment of FIG. 15 a plug, such as 13 in FIG. 13, is modified to form the body 48 of a way valve similar to that in FIG. 14. Corresponding parts are therefore identified by the same reference numbers. Through an opening 49 which, according to the direction of flow, may be an entry or an exit, the valve is connectable to another channel, not shown in the drawing. The body 48 also contains an inlet or outlet bore 53 in the axial direction of the distributor modules.

Figure 16:
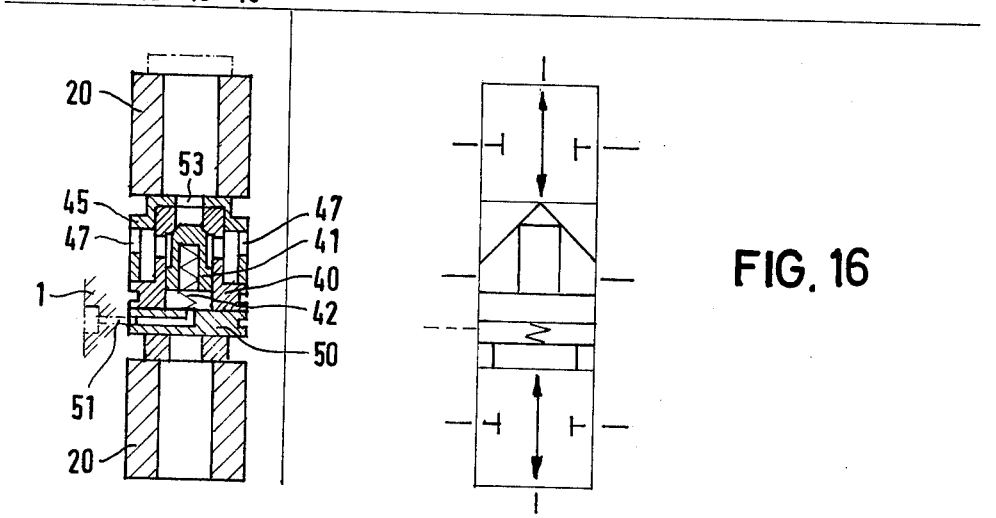
FIG. 16 is a section of a cartridge type way valve interposed between two distributor modules, and the corresponding symbolised circuit element on the right.

In the arrangement shown in FIG. 16 a way valve is shown interposed between two distributor modules 20, for instance as would be possible in a column of distributor modules contained inside a transverse bore 8. The construction of the cartridge type way valve again corresponds to that of the valve in FIG. 14, and corresponding parts are again identified by like reference numbers. As the way valve is here included in the column of distributor modules the control plate 43 is here replaced by a control disc 50 which is connectable through a bore 51 in the valve base 1 to a control pipe, not shown, for a controlling pressure fluid. The control disc 50 may be of the same dimensions, and perform the same functions, as a spacing disc 10 between distributor modules (of. FIG. 3).

FIGS. 17 and 18 show how two bodies 34 and 35 can be joined end to end to provide a base for a greater number of valves. Thus a duplex valve base 34 on which two hydraulic valves 5 (as described with reference to FIG. 2) can be mounted, has two transverse bores 8. In place of the cover 17 in FIG. 1 there is bolted to this duplex base 34 a further base 35 which is a triplex base. The two are bolted together by stud bolts 36 screwed into one end of one of the bases and held by nuts 37 located in recesses 38 in the end portion abutting that containing the bolts. The channels F, P, T, A, B are sealed by O-rings contained in chambers 39. Tapped holes 52 are shown in FIG. 18 and serve to fix the control plates 43 or valve bodies 48 or to secure end plates corresponding to the plugs 13 in FIG. 3. Incidentally parts which in FIGS. 17 and 18 correspond to parts shown in FIGS. 1 to 3 are again identified by the same references and not described again.

FIG. 19 diagrammatically illustrates how any desired lengths of a strip-shaped valve base can be built up from a combination of duplex and triplex bodies. Valve base strips comprising between two and seven groupings of holes or transverse channels 8 are shown. FIG. 20 is a diagram illustrating the combination of simplex and triplex valve bases to construct desired strip lengths of such bases. Combinations comprising from one to seven repeat patterns or groupings of holes and transverse bores 8 are shown.

What we claim is:

1. A valve base for connecting hydraulic valves in hydraulic circuits, comprising a body (affording) having a number of longitudinal channels extending end to end through it, said channels having coplanar axes (with their axes coplanar,) for the supply and return of a hydraulic fluid and for other hydraulic connections from the valves, groups of holes in said body and each in a (standardised) predetermined pattern to fit a (standardised) predetermined pattern of connections of a hydraulic valve, said groups of holes communicating with respective channels a transverse bore associated with each group of holes and intersecting all the longitudinal channels, (and in each transverse bore,) a column of distributor elements in each transverse bore and (modules which are) held in the bore by terminal members at the ends of the transverse bore, one distributor (module) element being located at each intersection of the transverse bore with each longitudinal channel, said distributor elements interconnecting predetermined channels for forming a predetermined hydraulic circuit, a solid spacing disc forming a partition blocking said transverse bore, at least one of said terminal members having in it an opening in alignment with axial bores of said distributor element and adapted for connection of a pipe thereto, each transverse bore being located at an intermediate position in the portion of the length of the body containing the respective group of holes, said spacing disc being located between each pair of neighboring distributor elements in a column.

2. A valve base as claimed in claim 1 in which the transverse bores have a diameter exceeding that of the longitudinal channels.

3. A valve base as claimed in claim 2 in which the distributor elements are cylindrical bodies having an external diameter corresponding to the internal diameter of the transverse bores and each provided with an axial bore extending through it.

4. A valve base as claimed in claim 3, in which at least one distributor element affords a lateral opening communicating with its axial bore.

5. A valve base as claimed in claim 4 in which at least one distributor element contains a valve controlling flow through a lateral opening.

6. A valve base as claimed in claim 3 in which at least one distributor element affords two diametrically opposite lateral openings communicating with its axial bore.

7. A valve base as claimed in claim 3, in which at least one distributor element has a circumferential groove in its external surface.

8. A valve base as claimed in claim 3, in which at least one distributor element contains a valve controlling flow through its axial bore.

9. A valve base as claimed in claim 3, having a spacing disc interposed between each pair of neighbouring distributor elements in a column.

10. A valve base as claimed in claim 9 in which a spacing disc is annular and allows flow through it.

11. A valve base as claimed in claim 9, in which at least one spacing disc has a diameter less than that of the distributor elements and is encircled by a sealing ring to provide a radial seal.

12. A valve base as claimed in claim 9, in which each face of a spacing disc is formed round its periphery with an axially projecting sharp rib to provide a metallic axial seal with the neighbouring distributor elements.

13. A valve base as claimed in claim 1, in which at least one distributor module is constituted by a way valve in the form of a push-in cartridge having an overall diameter corresponding to the diameter of the transverse bores, and having an opening in the axial direction of the transverse bore, and an opening communicating with one of the longitudinal channels.

14. A valve base as claimed in claim 13, in which the valve has a diameter less than that of the transverse bore and an adapter sleeve is interposed between the valve and the wall of the transverse bore.

15. A valve base as claimed in claim 1, in which at least one of the terminal members at the ends of the transverse bore is modified to form the body of a cartridge type hydraulic valve having an opening in alignment with the transverse bore and an opening outside the base for connection of the valve to an external pipe.

16. A valve base as claimed in claim 1, comprising two or more bodies, each having at least one group of holes and at least one transverse bore connected together end to end with the longitudinal channels in alignment.

17. A valve base as claimed in claim 16, comprising two bodies, one having two and the other three groups of holes and associated transverse bores.

18. A valve base as claimed in claim 16, comprising two bodies, one having one and the other three groups of holes and associated transverse bores.

* * * * *